US007641510B2

(12) United States Patent
Byrne

(10) Patent No.: US 7,641,510 B2
(45) Date of Patent: Jan. 5, 2010

(54) FOUR WAY JUMPER/HALF BLOCK

(76) Inventor: Norman R. Byrne, 2736 Honey Creek NE., Ada, MI (US) 49301

( * ) Notice: Subject to any disclaimer, the term of this patent is extended or adjusted under 35 U.S.C. 154(b) by 0 days.

(21) Appl. No.: 11/912,821

(22) PCT Filed: May 1, 2006

(86) PCT No.: PCT/US2006/016485

§ 371 (c)(1),
(2), (4) Date: Oct. 26, 2007

(87) PCT Pub. No.: WO2006/121657

PCT Pub. Date: Nov. 16, 2006

(65) Prior Publication Data

US 2008/0214034 A1 Sep. 4, 2008

Related U.S. Application Data

(60) Provisional application No. 60/676,656, filed on Apr. 29, 2005.

(51) Int. Cl.
*H01R 4/60* (2006.01)

(52) U.S. Cl. ..... 439/514

(58) Field of Classification Search ..... 439/214, 439/215, 210, 502
See application file for complete search history.

(56) References Cited

U.S. PATENT DOCUMENTS

| | | | | |
|---|---|---|---|---|
| 5,041,009 | A * | 8/1991 | McCleerey | 439/405 |
| 5,108,313 | A * | 4/1992 | Adams | 439/610 |
| 6,737,585 | B2 * | 5/2004 | Aoyama et al. | 174/68.1 |
| 7,201,593 | B2 * | 4/2007 | Kondas et al. | 439/215 |

* cited by examiner

*Primary Examiner*—Phuong K Dinh
(74) *Attorney, Agent, or Firm*—Varnum, Riddering, Schmidt & Howlett LLP

(57) ABSTRACT

A jumper assembly (100) adapted for use in connecting junction block to conduit having electrical cable running therethrough and wherein the junction blocks are half junction blocks, the jumper assembly including: a first plurality of wire conductors (306) and a second plurality of wire conductors (308) are each electrically and structurally connected to a terminal set comprising a half H-shaped terminal set having a series of first terminal blades (312) and a series of second terminal blades (314), each set of terminal blades bein commonly integral with an elongated common blade (316).

10 Claims, 17 Drawing Sheets

FOUR WAY JUMPER/HALF BLOCK

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

1. Field of the Invention

The invention pertains to electrical interconnection systems and, more particularly, to systems for use in distributing electrical power within modular wall panels or the like.

2. Background Art

Known interior wall systems typically employ prefabricated modular units which are joined together in various configurations to divide a workspace into smaller offices or work areas. Generally, such modular wall panels are equipped with raceways. The raceways house electrical cabling and junction blocks in order to provide electrical outlets and electrical power connections to adjacent panels. The raceway of a modular wall unit may be provided with a male connector at one end and a female connector at another end, along with junction blocks. The junction blocks can incorporate electrical outlets, disposed at spaced apart positions along the raceway. Conduits can extend between the junction blocks and between the connectors in the junction blocks. This is for purposes of providing electrical interconnection between junction blocks, panels and other components. These conduits can also be connected to an initial source of external power. The conduits for connections are often referred to as "jumpers." The jumpers may have a conduit with a plurality of conductors, and with one end of the conduit connected to a cable connector. The cable connector may be a universal connector adapted to electrical connect to junction blocks or the like.

BRIEF DESCRIPTION OF THE SEVERAL VIEWS OF THE DRAWING

An illustrative embodiment of the invention is described in the following detailed description, with reference to the drawings, in which.

DESCRIPTION OF THE PREFERRED EMBODIMENT

The principles of the invention are disclosed, by way of example, in a four way jumper/half block assembly 300 as illustrated in FIGS. 9-21. The jumper/half block assembly 300 advantageously provides the capability of interconnecting what are typically characterized as junction half blocks or half junction blocks to conduits having electrical cables running therethrough. The electrical cables typically correspond to and carry a plurality of electrical circuits, with the circuits often having hot, neutral and ground cable or wire connections. These conduits often comprise covered or otherwise isolated wire conductors running therethrough, with the conductors being connected within a junction block to sets of blade terminals. These blade terminals then run through the junction block and are terminated within a blade terminal connector block. The blade terminal connector block can be one which presents either male or female connector terminals, so that the connector terminals are accessible and connectable to other electrical components, such as a universal cable connector or the like. In particular, the jumper/half block assembly 300 in accordance with the invention provides the capability of utilizing a half junction block while still having four way interconnections which can be extended through walls or office panels.

For purposes of describing a configuration where a junction block assembly in accordance with the invention may be utilized, the immediately following paragraphs describe a prior art electrical connection assembly which could be adapted for use within wall panels of a space divider system. The electrical interconnection assembly is shown in the prior art drawings of FIGS. 1-8, and depict a junction block having several receptacle connectors to provide a plurality of electrical outlets on both sides of a wall panel. The block is connected by means of conduits extending from both ends of the junction block to oppositely directed connector blocks for connection to adjoining junction blocks or adjoining panels. This assembly allows electrical power to be supplied to one end of a panel and conducted to and through the junction block to other panels. Following the description of the prior art system, the jumper/half block assembly 300 and an alternative embodiment 400 in accordance with the invention will be described.

Figure 1:
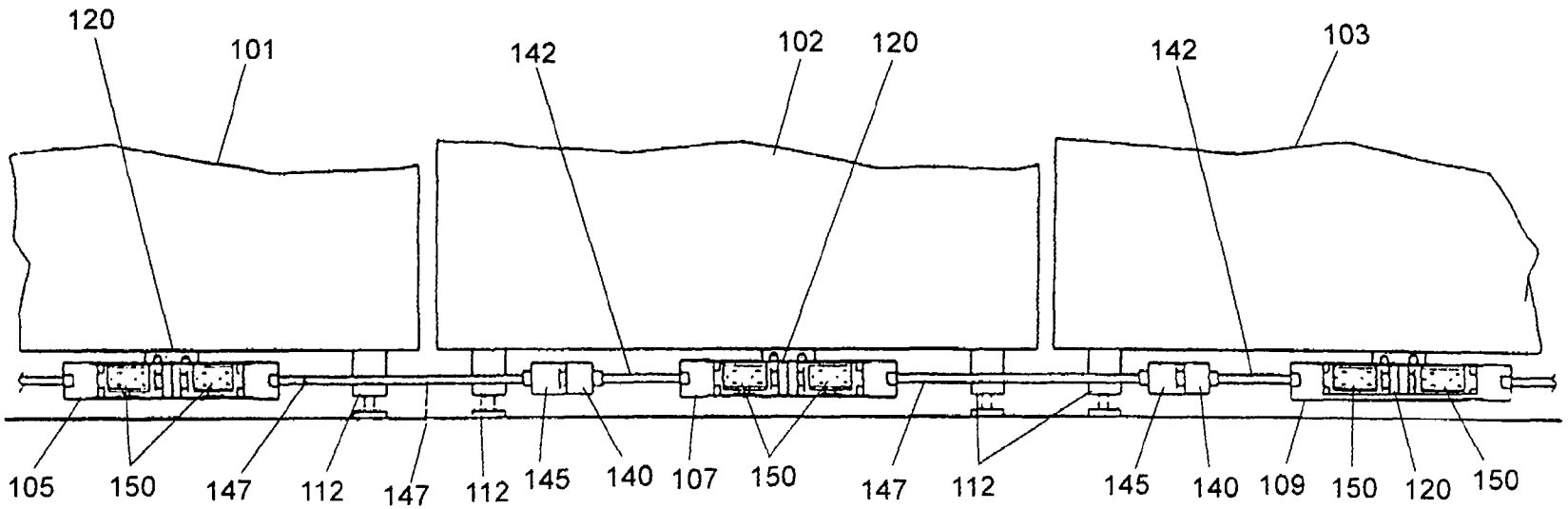
Fig. 1 (Prior Art)
FIG. 1 is a fragmentary elevation view of a plurality of adjacent wall panels and electrical connection assemblies in accordance with a prior art configuration.

FIG. 1 is a fragmentary elevation view of adjacent modular wall panels 101, 102, 103 of a rearrangeable wall system. The wall panels are provided with electrical interconnection assemblies 105, 107 and 109 in a raceway area formed along the lower edge of panels 101, 102 and 103. Each of the panels is provided with substantially flat support legs 112 which allow for passage of electrical conduits in the raceway. Raceway covers, customarily used, have been omitted from the drawing in FIG. 1 to better show the electrical junction assemblies. Each of the electrical interconnection assemblies 105, 107, and 109 is provided with a junction block 120, a female electrical connector block 140 and a matching male connector block 145. The connector blocks 140, 145 are connected to associated junction blocks 120 by means of conduit sections 142 and 147, respectively. Each of the junction blocks 120 is shown in FIG. 1 to be provided with a pair of electrical outlet receptacles 150. Junction blocks 120 are double sided and corresponding pairs of outlet receptacles are provided on the opposite side of each of the wall panels 101, 102 and 103 (not shown in the drawing) to allow various electrical equipment to be plugged into the outlets from either side of the panel.

Figure 2:
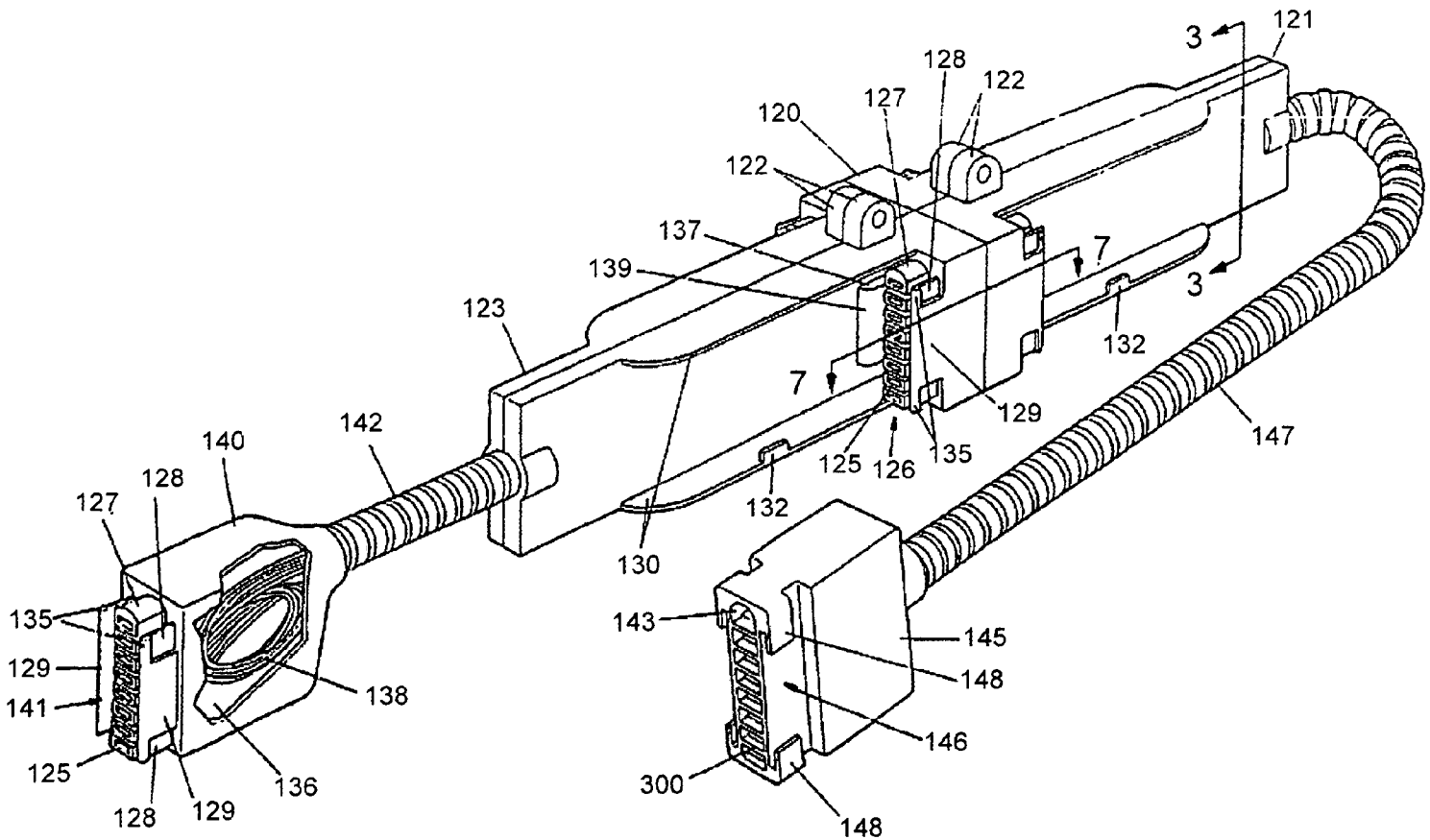
Fig. 2 (Prior Art)
FIG. 2 is an enlarged perspective view of one of the interconnection assemblies of FIG. 1.

FIG. 2 is an enlarged perspective view of one of the electrical interconnection assemblies, for example assembly 107. The junction block 120 is provided with support lugs 122 by which the junction block is supported by standard fasteners extended through support tables extending from the bottom edge of the wall panel, e.g., wall panel 102. Junction block 120 comprises an elongated housing having opposing ends 121 and 123 and a symmetrical center section comprising four female receptacle connectors 126. Only one of the receptacle connectors 126 is fully exposed in FIG. 2. There is a pair of connectors 126 on each side of the housing and the connection on each side face in opposite directions. Support flanges 130 are provided adjacent each of the female connectors to provide support for electrical outlet receptacles engaged with the connectors 126. In this manner, junction block 120 is adapted to support four electrical outlet receptacles, two on each side of a wall panel to which junction block 120 is attached. The junction block assembly further comprises end connector block 140, provided with a female connector 141, and connected via a standard electrical conduit 142, which may be a flexible conduit, to end 123 of junction block 120. Similarly, connector block 145, provided with a male connector 146 is connected via flexible conduit 147 to end 121 of junction block 120. In a straight line connection arrangement, as depicted for example in FIG. 1, wherein a plurality of panels are positioned adjacent each other, electrical power is transmitted between panels by connection of male connector block 145 to female connector block 140 of the adjacent junction assembly.

Electrical power is transmitted through the junction assembly by means of electrical wires disposed in the conduits 142, 147, terminated on connectors 141 and 146, respectively, and connected to receptacle connectors 126 in junction block 120. Accordingly, electrical power is transmitted through interconnecting panels and is at the same time made available at electrical outlet receptacles in each panel. Conduit 147, provided with the male connector block 145, may be a fixed-length conduit and conduit 142 may be of a length such that female connector block 140 is positioned at substantially the same distance from the panel edge in each panel independent of the width of the panel. Thus, female connector block 140 will always be accessible to male connector block 145 independent of the width of the panels. To accommodate panels of different widths, conduit 142 may be an expandable flexible conduit, such as are well known in the art. In that case, connector block 140 may be provided with an inner spatial area 136, as shown in a partially broken-away view in FIG. 2. The inner spatial area 136 is provided for storage of excess length of electrical wiring 138 in a coiled or other configuration. The excess length of electrical wiring 138 may be withdrawn when conduit 142 is expanded to an extended length. This arrangement is similar to that disclosed in my earlier patent, U.S. Pat. No. 4,579,403(dated Apr. 1, 1986) and entitled ELECTRICAL JUNCTION ASSEMBLY WITH ADJUSTABLE CONNECTORS.

Figure 4:
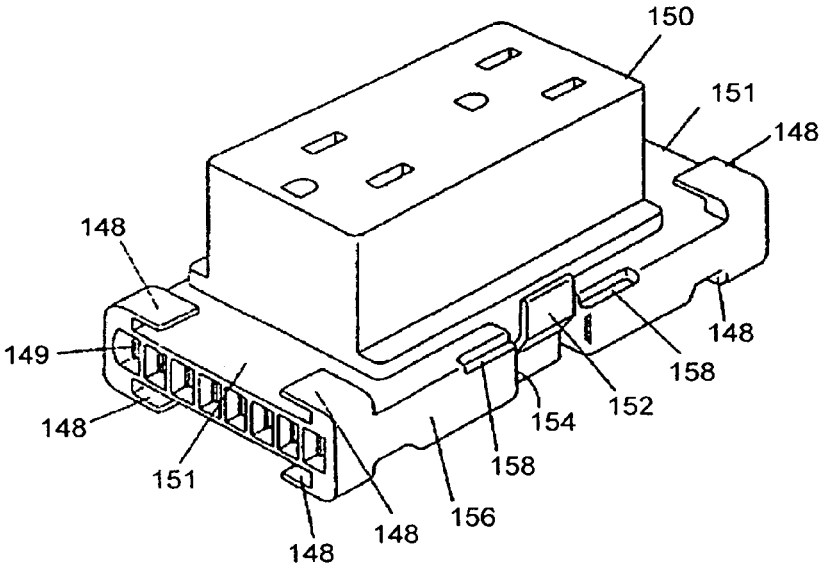
Fig. 4 (Prior Art)
FIG. 4 is an enlarged perspective view of an outlet receptacle shown in FIG. 1.

The conduit 147 is preferably a flexible conduit which may be bent to accommodate a connection to adjacent panels which are disposed at angular positions with respect to each other, rather than in a straight line. The junction assemblies of this invention readily accommodate an arrangement in which three or more panels are disposed in an intersecting relationship, as will be discussed farther herein with respect to FIG. 6. In such a configuration, the male connector block 145 of one of the panels may be connected to one of the female receptacle connectors 126 of a junction block assembly in an adjacent wall panel. For this purpose, the female connector 141 of connector block 140 and female receptacle connectors 126 on junction block 120 have been made identical. Similarly, the male connector 146 on connector block 145 has been made identical to the male connector of electrical outlet receptacle 150, shown in FIG. 1. Greater detail of the receptacle 150 is shown in FIG. 4 and is described below. As may be seen from FIG. 2, the female connectors 126 and 141 are each provided with a pair of side flanges 129 having upper and lower recessed areas 128, for engagement with flanges 148 of a male connector to provide a locking arrangement. FIG. 129, which are made of a resilient plastic material and formed integral to the housing to which they are connected, are provided with an outwardly extending inclined end surface 135. When surfaces 135 are engaged by flanges such as flanges 148 of connector 146 on connector block 145, the flanges 129 will be deflected inward, allowing flanges 148 of the male connector to engage recesses 128 to provide a locking engagement of the male and the female connectors. A protuberance 137 is provided with a generally rounded edge surface 139 and acts as an entry guide as a male connector is engaged in female connector 126. The female connectors 126, 141 are each provided with a plurality of female connector terminals 125 and a key lug 127. Male connector 146 is provided with a plurality of male connector terminals 149 and an opening 143 for receiving key lug 127.

Figure 5:
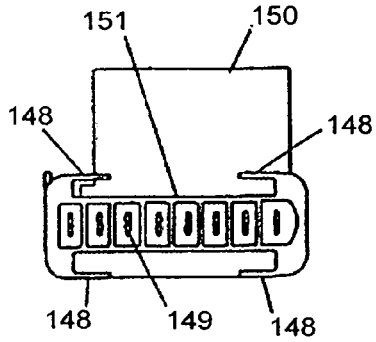
Fig. 5 (Prior Art)
FIG. 5 is a side elevation of the outlet receptacle of FIG. 4.

The electrical outlet receptacle 150, shown in FIG. 4, is provided with male connectors 151 at both ends, allowing the receptacle to be plugged into any one of the four female receptacle connectors 126 of junction block 120. As shown in FIG. 2, junction block 120 is provided with upper and lower support flanges 130 to support receptacles 150 in each of the four female connectors 126. The lower support flanges 130 are provided with a locking flange 132. The receptacle 150 is provided with a spring latch 152 disposed in recess 154 in the surface 156 of receptacle 150. Surface 156 engages one of the lower support flanges 130 when the receptacle 150 is installed in the junction block 120. The locking flanges 132 will be aligned with the recess 154 when the receptacle 150 is inserted between flanges 130, causing the spring latch 152 to be depressed. The receptacle 150 may then be moved to either the left or to the right to engage one of the female connectors 126. Recesses 158 are provided in receptacle 150 to accommodate locking flange 132 and movement to either the left or to the right by a sufficient distance will cause the spring latch 152 to be moved past locking flange 132, causing the spring latch 152 to return to its extended position. Hence, receptacle 150 will be retained in a locked position. The receptacle may be removed by depressing spring latch 152 and sliding the receptacle 150 to either left or right to align the locking flange 132 with recess 154. FIG. 5 is a right-hand elevation of receptacle 150 showing a right-hand elevation or receptacle 150 showing right-hand male connector 151.

Figure 3:
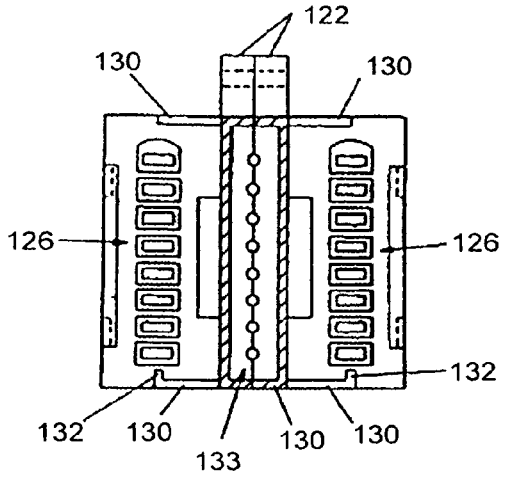
Fig. 3 (Prior Art)
FIG. 3 is a cross-sectional view taken along lines 3-3 of FIG. 2.

FIG. 3 is a cross-sectional view of junction block 120 taken along line 3-3 of FIG. 2. FIG. 3 shows two of the four receptacle connectors 126 of connector block 120. One of the two connectors 126 shown in FIG. 3 is disposed on each side of the central housing section 131, which contains a plurality of wires 133. An eight-wire system is shown in this illustrative embodiment. Each of the male and female connectors are provided with eight separate terminals, and eight separate electrical wires 133 extend through the connector blocks 140, 145, the conduits 142, 147 and the central section 131 of the junction block 120. By way of example, these may include two ground terminal wires, three neutral wires and three positive wires representing three separate circuits, with a shared ground for two of the circuits. Similarly, 10- or 12-wire systems may be readily accommodated, having corresponding number of terminals on each of the connectors and providing a greater number of separate circuits. The four female receptacle connectors 126 are each connected to the wires 133 by means of a plurality of contact blades, described later herein with respect to FIGS. 7 and 8. Each wire, together with the connector block terminals and receptacle connector terminals to which it is connected, is referred to herein as a circuit element. A particular circuit may be selected for use by one of the receptacles 150 by appropriate wiring connections internal to the receptacle. Since all of the circuits are connected to each one of the receptacle connectors 126 of junction block 120, a connector block 145 of an adjacent panel, equipped with a male connector, may be connected to any one of the receptacle connectors 126. In this manner, electrical power may be provided to receptacle connectors to junction block 120 and to associated connector blocks 140, 145 and hence to any adjacent panels to which these connectors may be connected. Similarly, a connector block 145 equipped with a male connector connected to one of the female connectors 126 may receive electrical power for distribution to a panel to which the connector block 145 belongs. Such interconnecting arrangements are described further herein with respect to FIG. 6.

Figure 7:
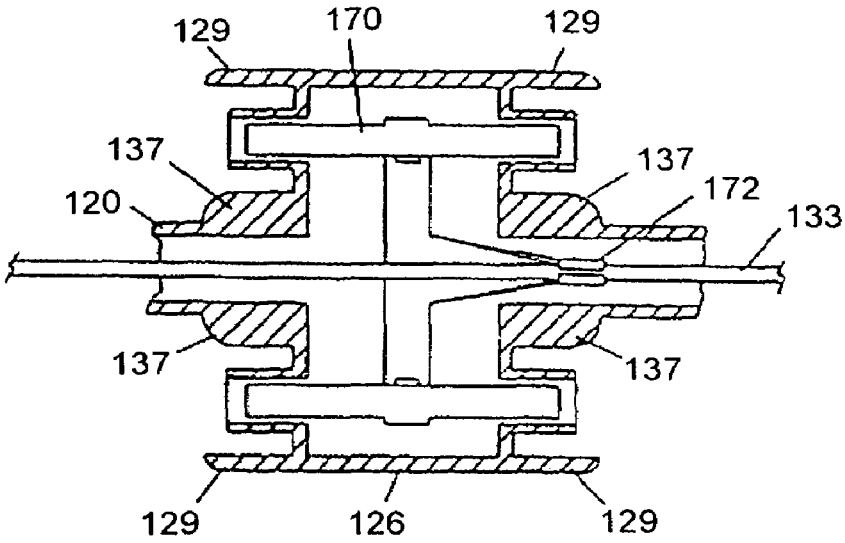
Fig. 7 (Prior Art)
FIG. 7 is a fragmentary cross-sectional view along lines 7-7 of FIG. 2.
Figure 8:
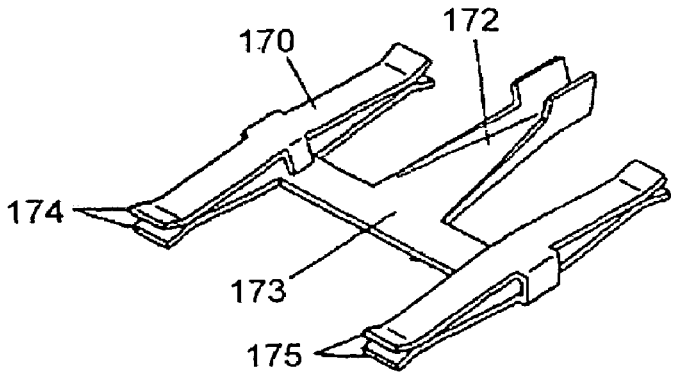
Fig. 8 (Prior Art)
FIG. 8 is a perspective view of a receptacle contact blade shown in FIG. 7.

FIG. 7 is a fragmentary cross-sectional view along line 7-7 of FIG. 2. Shown in FIG. 7 is a contact blade structure 170 which is one of eight such blades disposed in central housing section 131. Each such blade is in electrical contact with one of the conductors 133. Connection to conductor 133 is made by means of a crimped connection of blade extension member 172 to conductor 133. As may be more readily seen from the perspective view of FIG. 8, the extension member 172 is part of a center section 173 which is connected to left-hand upper and lower contact blades 174 and right-hand upper and lower contact blades 175. The upper and lower contact blades on each side from the female opening part of the conductor 126 for engagement with blades of a male connector.

Figure 6:
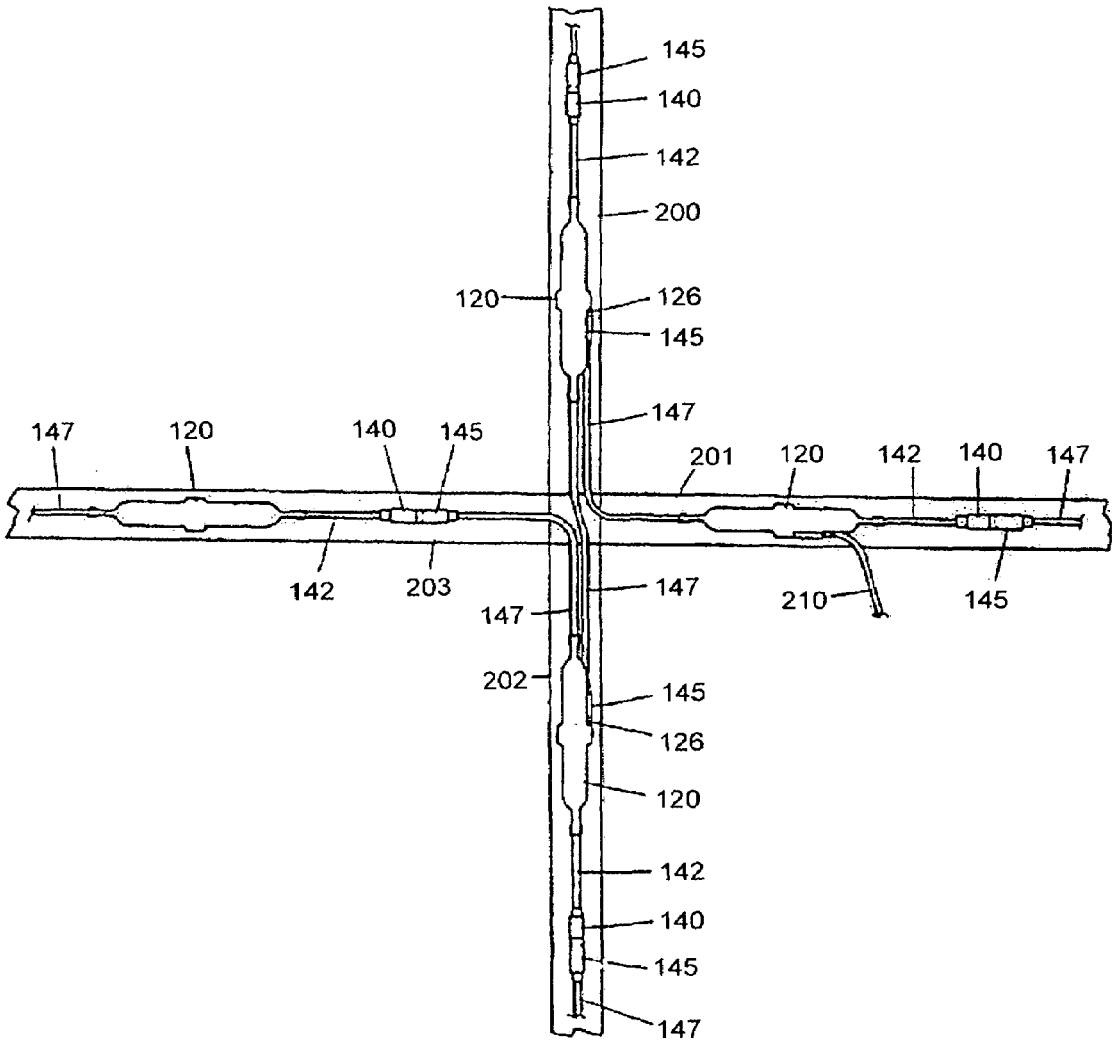
Fig. 6 (Prior Art)
FIG. 6 is a fragmentary plan view of raceway areas of four wall panels, illustrating wall panel interconnections in accordance with a prior art arrangement.

FIG. 6 is a fragmentary plan view of raceway areas of four wall panels illustrating the connections of interconnection assemblies of the invention in a configuration in which the four panels are disposed at right angles to each other. As will be apparent from the following description, the specific angle at which the panels are positioned is not particularly significant. Furthermore, the invention is equally applicable to a three-panel configuration or a five-panel configuration disposed at right angles to each other. Each of the four panels is provided with an interconnection assembly, as shown in FIG. 2, comprising a junction block 120, a male connector block 145, and a female connector block 140 attached to the junction block 120 by means of flexible conduits 147 and 142, respectively. The junction block 120 is disposed within each panel raceway near one edge of the panel. Panels 200, 201, 202 are positioned such that the end at which these panels are joined to other panels is the end near which the junction block 120 is positioned. One of the panels, panel 203, is positioned with an opposite orientation in which the end near which the junction block 120 is located is positioned opposite the point of junction of the four panels. The flexible conduit 147, provided with the male connector block 145, extends beyond the end of the panel in which it is positioned, and the flexible conduit 142, provided with a female connector block 140, is terminated just short of the end of the panel. Thus, as is also shown in FIG. 1, a connection is made between panels by extending the flexible conduit 147 with male connector block 145 into the raceway area of the adjacent panel to engage the female connector block 140 at the end of flexible conduit 142. In the configuration of FIG. 6, the male connector block 145 of panel 202 and its associated flexible conduit 147 extend into the raceway area of panel 202 to engage female connector block 140 of panel 203. It will be apparent that the connection as shown between panel 202 and 203 may be made whenever these panels are adjacent and independent of the angle at which the panels are disposed with respect to each other. In the configuration of FIG. 6, the flexible conduit 147, with its male connector block 145, associated with the panel 200 are extended into the raceway area of panel 202 for engagement with one of the female receptacle connectors 126 ofjunction block 120 in panel 202. In this manner, an electrical connection is established among the junction blocks of the three panels 200, 202, and 203. Thus, electrical power provided from an external source to any one of these three may be distributed to the other two by means of the connection arrangement shown by way of example in FIG. 6. In the arrangement of FIG. 6, flexible conduit 147 and its male connector block 145 of panel 202 is connected to one of the female connectors 126 of junction block 120 of panel 200 thereby establishing an electrical connection between panels 200 and 201. This connection, in combination with the other connections shown in FIG. 6 and described in the previous sentences, completes an arrangement for establishing an electrical connection from any one of four panels to the entire four-panel configuration. Additional connections may be envisioned by connections of male connectors 145 from other panels into additional ones of the female receptacle connectors 126 of the junction blocks 120 of any of the panels 201 through 203, should one choose to provide an arrangement of more than four intersecting panels. Furthermore, additional conduits, such as conduit 210 shown in FIG. 6, may be connected by means of a male connector to any of the receptacle connectors 126 to provide electrical power to lamps or other fixtures. As can be seen, a great deal of flexibility has been achieved by the electrical junction assembly. The connection assembly disclosed in the foregoing paragraphs is described in my U.S. Pat. No. 5,171,159, issued Dec. 15, 1992 and titled ELECTRICAL CONNECTION ASSEMBLY.

Figure 9:
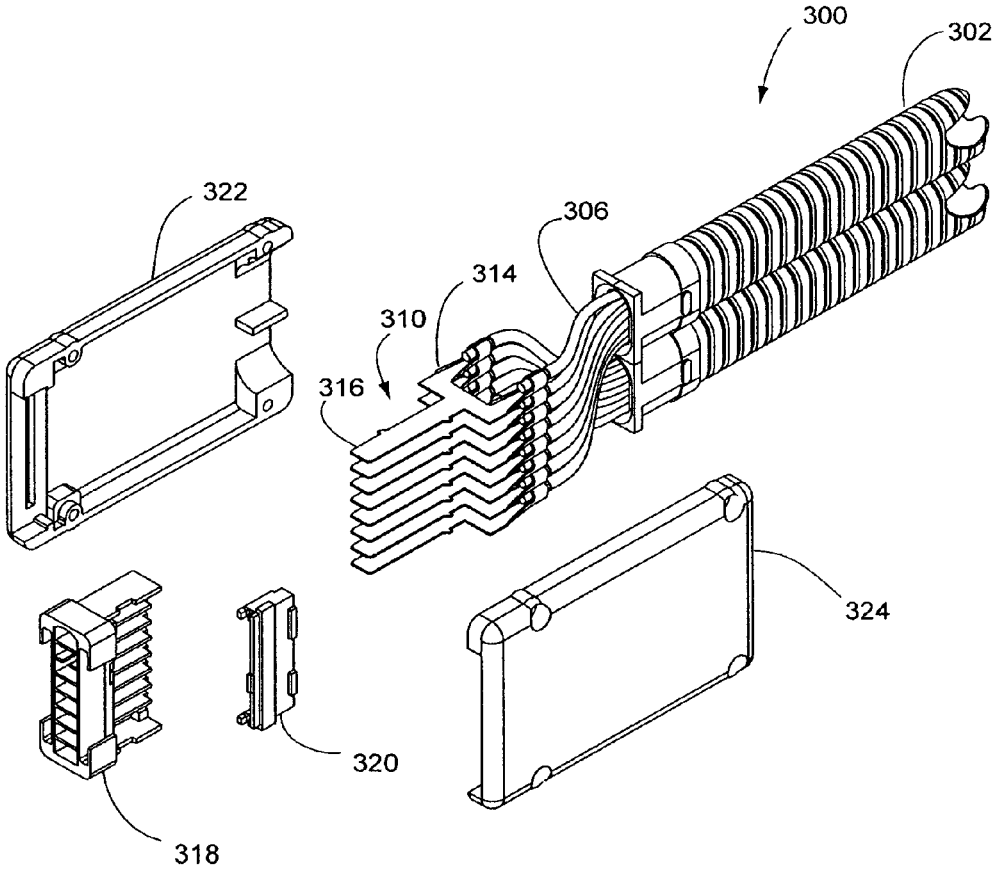
FIG. 9 is an exploded, perspective view showing components of a jumper/half block electrical assembly in accordance with the invention.

Turning now specifically to the invention, FIG. 9 illustrates a perspective, exploded view of a jumper assembly 300 in accordance with the invention. The jumper assembly 300 is adapted for use with what can be characterized as a half junction block, or otherwise any type of junction block where there may be a "center connect" to external cabling. The jumper assembly 300 includes a pair of conduits comprising a first conduit 302 and a second conduit 304. A first plurality of wire conductors 306 extends through the first conduit 302. Correspondingly a second plurality of wire conductors 308 extends through the second conduit 304.

The wire conductors 306, 308 are each electrically and structurally connected to a terminal set which can be characterized as a half H-shaped terminal set 310. The terminal set 310 includes a series of first terminal blades 312 and second terminal blades 314. The terminal blades 312, 314 are each commonly integral with an elongated common blade 316.

Figure 10:
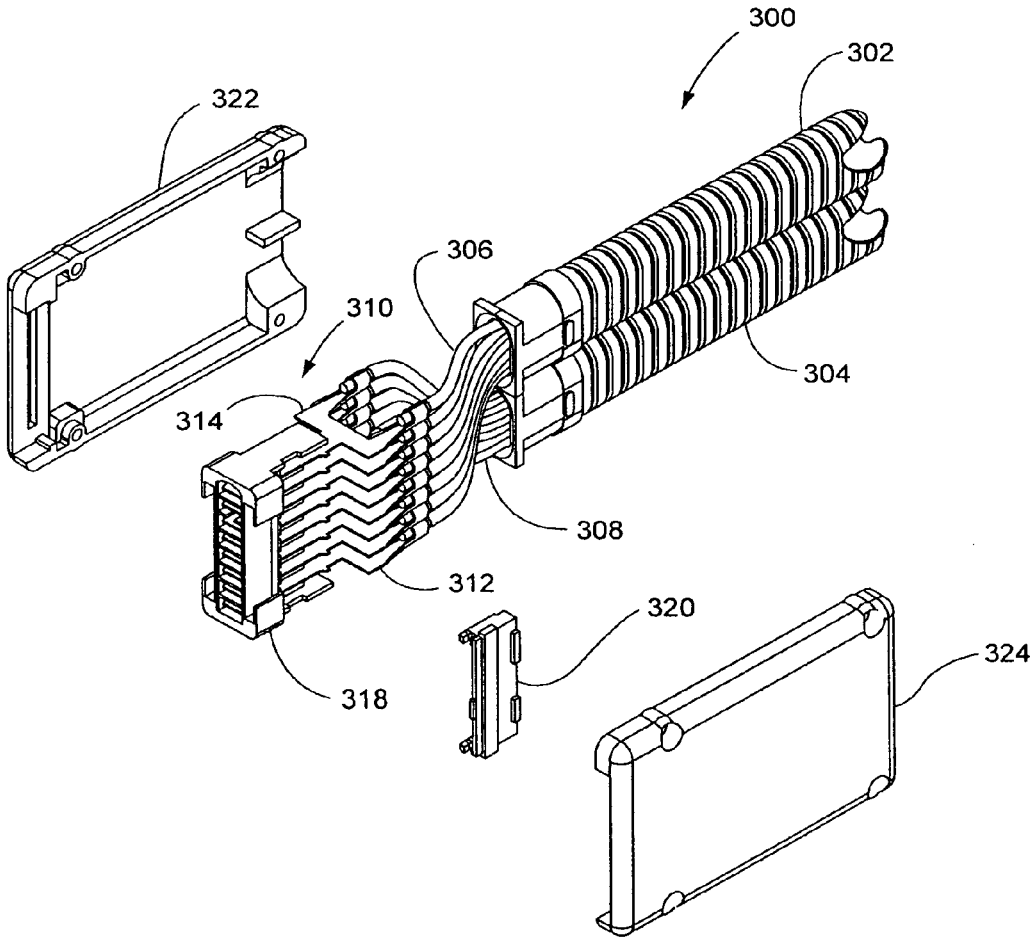
FIG. 10 is a view similar to FIG. 7, but showing the interconnection of a set of male blade terminals to a terminal connector block.
Figure 11:
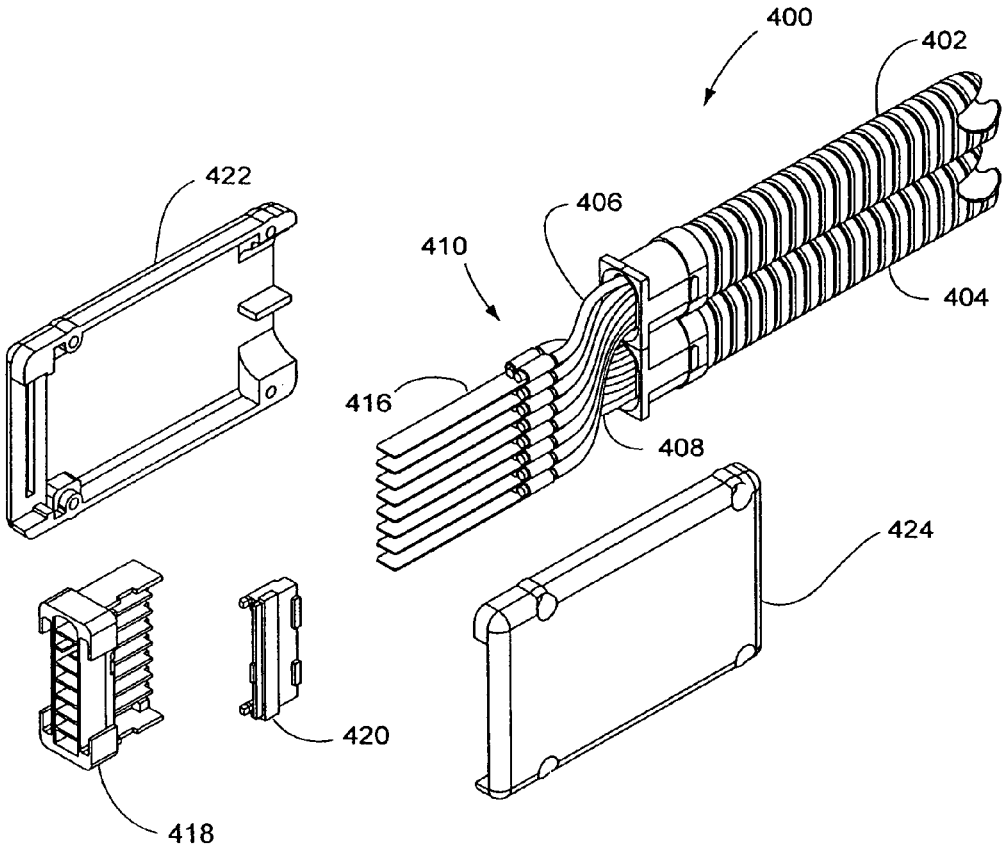
FIG. 11 is a view similar to FIGS. 9 and 10, but illustrates an alternative embodiment of the jumper/half block system, wherein conductors enclosed within a pair of conduits are both electrically connected to single blade terminations of a set of male blade terminals.

The ends of the common blade 316 extend into an end connector 318. The common blades 316 are "locked" into the end connector 318 by means of an insert 320. The end connector 318 provides for accessibility of external cabling to the common blade set 316. This configuration is illustrated in FIG. 10.

Figure 13:
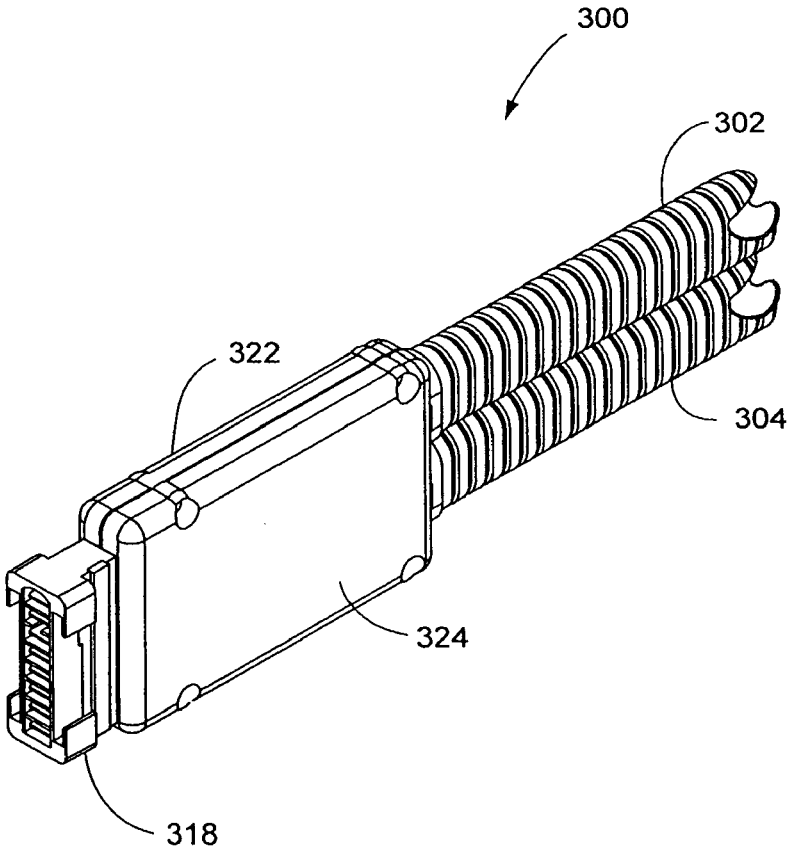
FIG. 13 is a perspective view of the jumper/half block connection assembly in accordance with the invention, in a fully assembled state.
Figure 15:
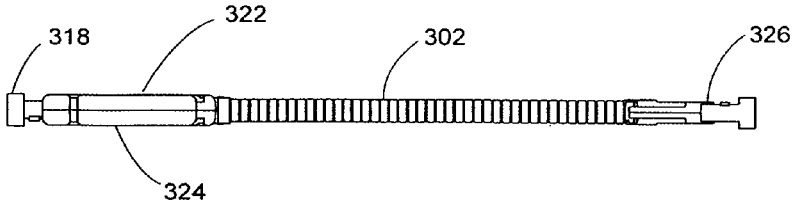
FIG. 15 is a plan view of the connection assembly illustrated in FIG. 14.

To complete the assembly, the jumper 300 includes a pair of cover plates, comprising a first cover plate 322 and a second cover plate 324. The cover plates can be connected together in any suitable manner (such as with screws, adhesives or the like) so as to enclose the terminal set 310 and part of the end connector 318. This fully assembled configuration is illustrated in FIG. 13.

Figure 12:
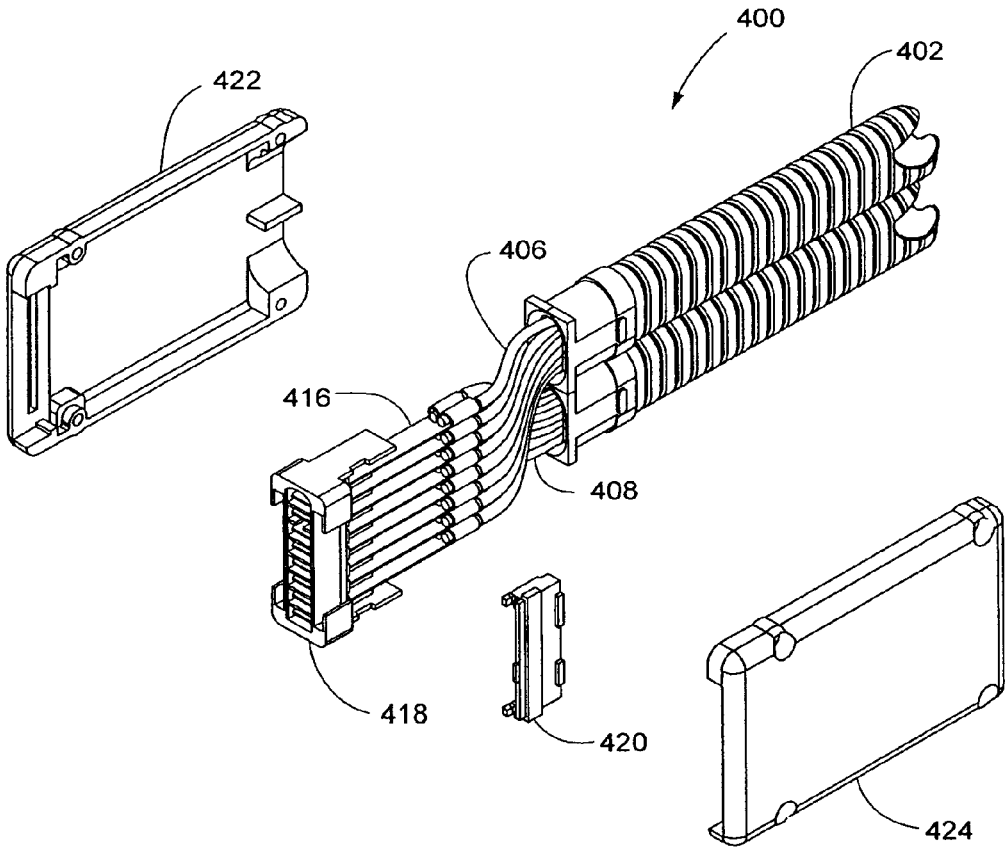
FIG. 12 is an exploded, perspective view similar to FIG. 11, showing the interconnection of the single male blade terminals of FIG. 11 to the terminal connector block.

As an alternative configuration, FIG. 12 illustrates a second embodiment of a jumper assembly 400 in accordance with the invention. As with the first jumper assembly 300, the jumper assembly 400 includes a first conduit 402 and a second conduit 404. A first plurality of wire conductors 406 extend through the first conduit 402. Correspondingly, a second plurality of wire conductors 408 extends through the second conduit 404. The ends of the conductors 406, 408 are electrically connected to a terminal set 410. Specifically, one of each of the conductors 406, 408 is connected to one elongated blade 416 of the terminal set 410. It will be appreciated that, unlike the jumper assembly 300, the terminal set 410 of the jumper assembly 400 includes only a single elongated blade 416, rather than a pair of terminal blades, such as the blades 312, 314 associated with jumper assembly 300.

Also like the jumper assembly 300, the jumper assembly 400 includes an end connector 418. The terminal ends of the elongated blades 416 are appropriately inserted into the end connector 418, so that the ends of the elongated blades are electrically accessible to external electrical components. An insert 420 is provided to "lock" the blades 416 within the end connector 418. To complete the assembly, the terminal set 410 is enclosed with a first cover 422 which is coupled to a second opposing cover 424. As apparent from the jumper assembly 300 and jumper assembly 400, the first and second conduits 302, 304 are aligned so that one is immediately above the other.

Figures 14, 16, 17:
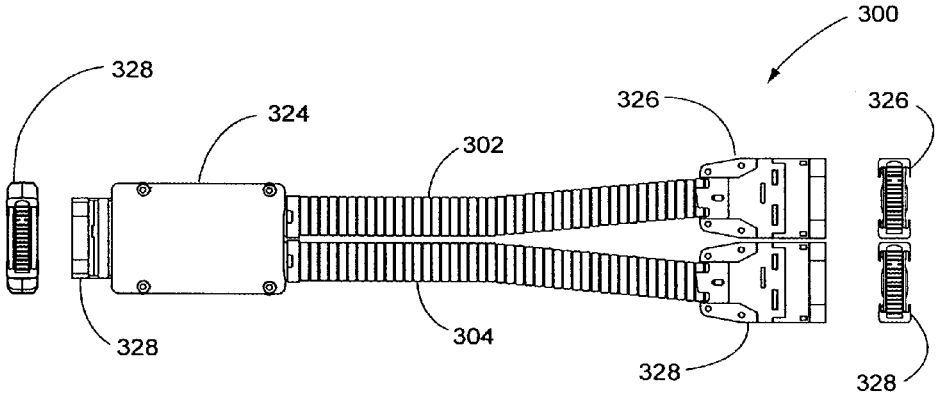
FIG. 14 is a side, elevation view of a jumper/half block connection assembly in accordance with the invention, with a pair of conduits coupled to a ganged pair of cable connectors.
FIG. 16 is an end view of the jumper/half block assembly illustrated in FIG. 14.
FIG. 17 is an end view opposing the end view of FIG. 16 and illustrating the ends of the pair of ganged cable connectors.

FIG. 14 illustrates the jumper assembly 300, with the opposing ends of each of the first and second conduits 302, 304, respectively, electrically coupled to a pair of ganged cable connectors 326, 328. The cable connectors 326, 328 can be conventional in design and are adapted to provide for connection of the wire conductors 306, 308 to external electrical components.

Figure 18:
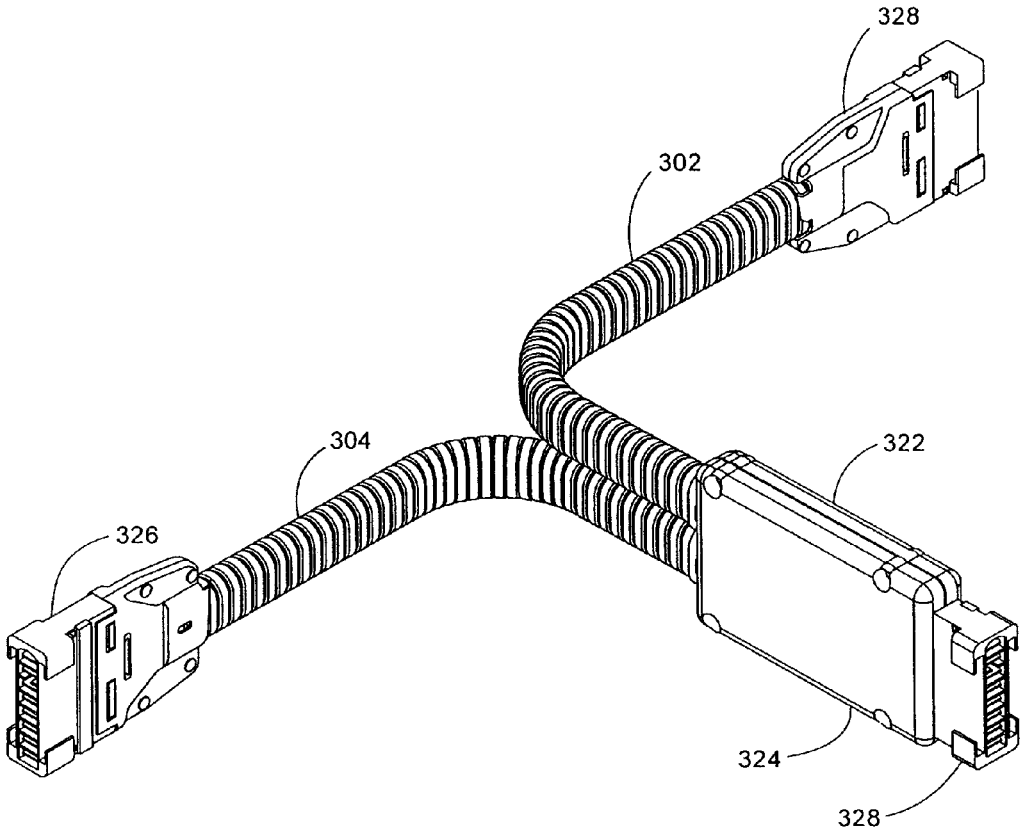
FIG. 18 is a perspective view of the jumper/half block connector assembly in accordance with the invention, showing interconnection to a pair of conduits and associated cable connectors which are separate and are being extended in opposing directions at right angles to the half block assembly.

FIG. 18 illustrates the jumper assembly 300 in a configuration with the cable connectors 326, 328 which is different than the configuration illustrated in FIG. 14. Specifically, in the configuration in FIG. 18, the cable connectors 326, 328 are not ganged, but instead are directed in opposing directions.

Figure 19:
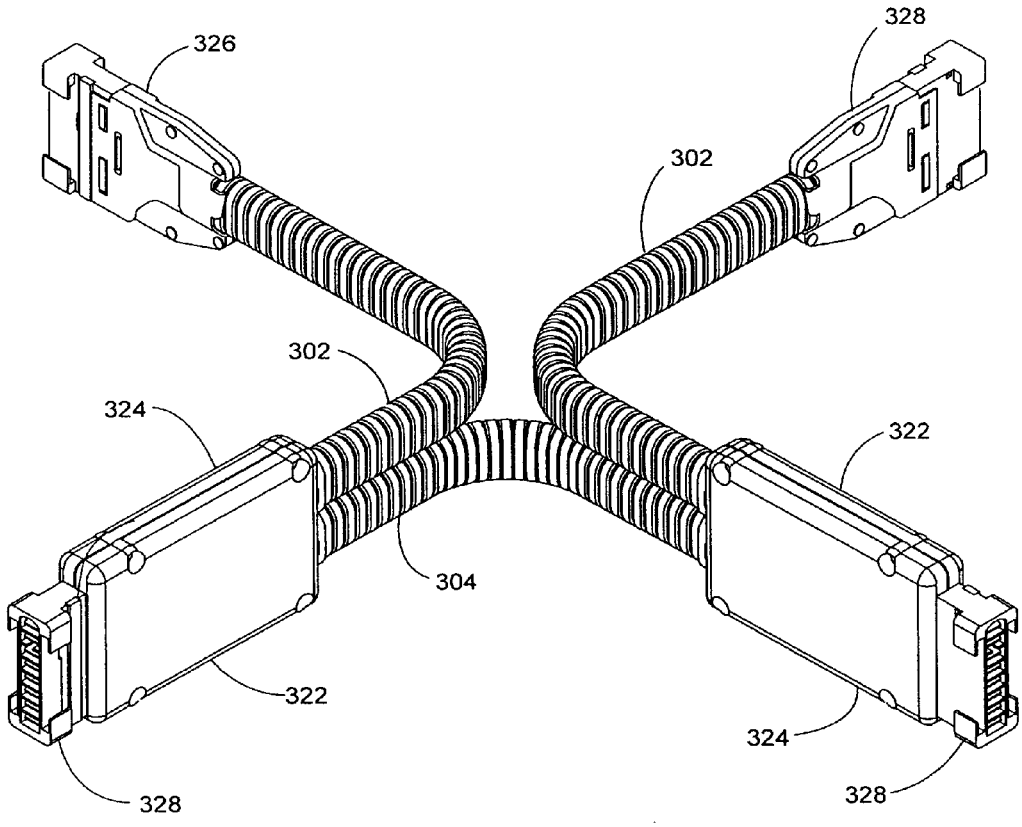
FIG. 19 is a perspective view showing a pair of half block assemblies in accordance with the invention, with the connector assemblies both connected to one conduit and with each assembly being connected to a separate conduit with a cable connector at the end thereof.

FIG. 19 illustrates a further configuration utilizing a pair of jumper assemblies 300. Each of the jumper assemblies 300 of the pair is connected as previously described herein to a first conduit 302 and a second conduit 304. However, in this particular configuration, one of the jumper assemblies 300 is connected to one first conduit 302, while the other jumper assembly 300 is connected to a different first conduit 302. However, both of the jumper assemblies 300 of the pair are each connected to opposing ends of the second conduit 304.

Figure 20:
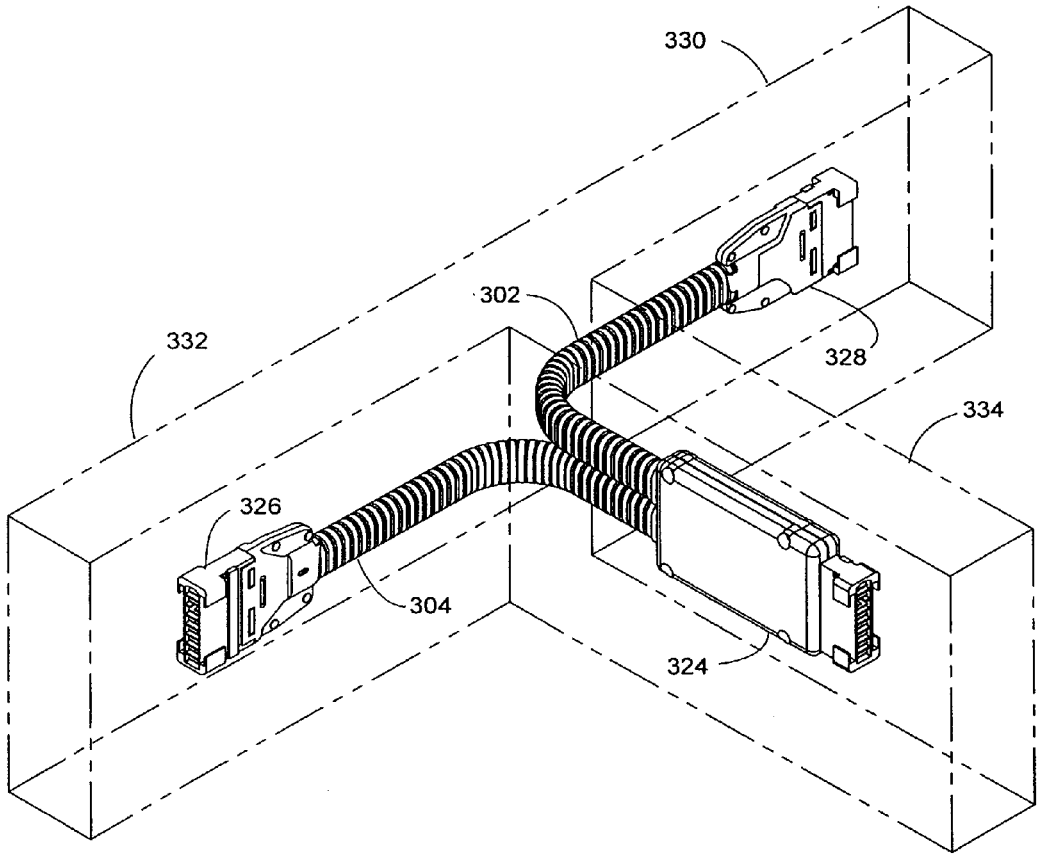
FIG. 20 illustrates the connector assembly configuration in accordance with the invention as shown in FIG. 18, but with the configuration being shown within a set of walls or office panels, with the walls or office panels being shown in phantom line format.
Figure 21:
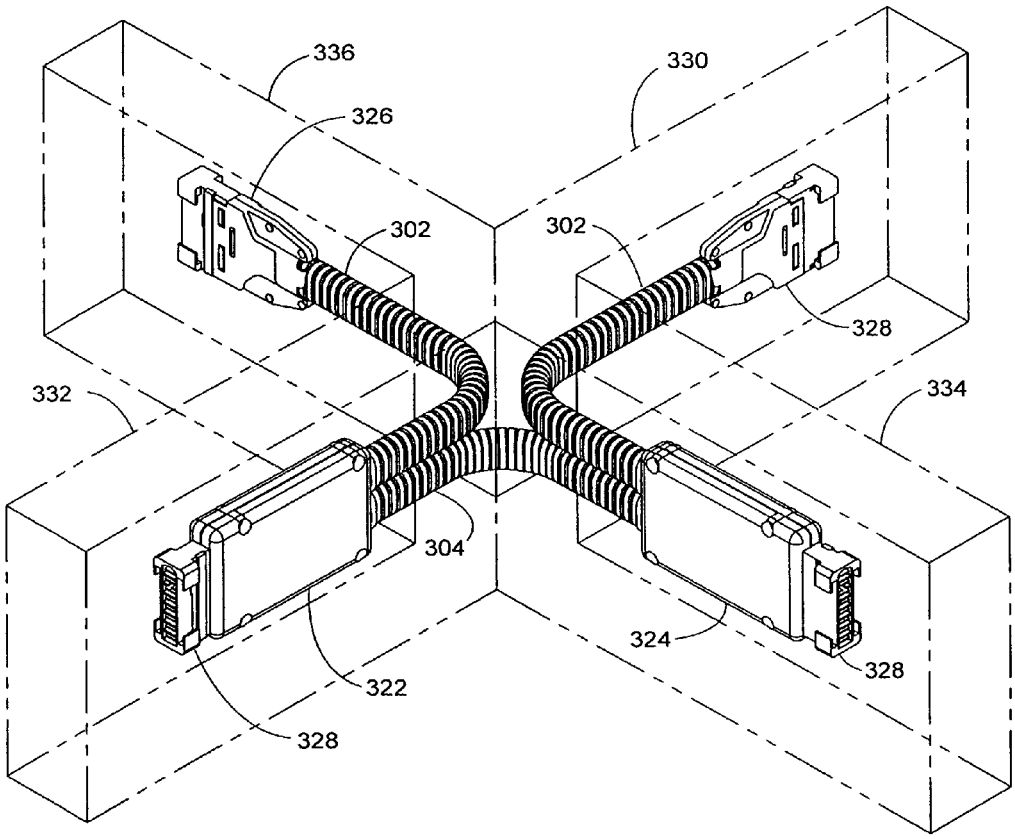
FIG. 21 is a perspective view similar to FIG. 20, but showing the connector assembly configuration of FIG. 19 within a set of walls or office panels.
Figure 22:
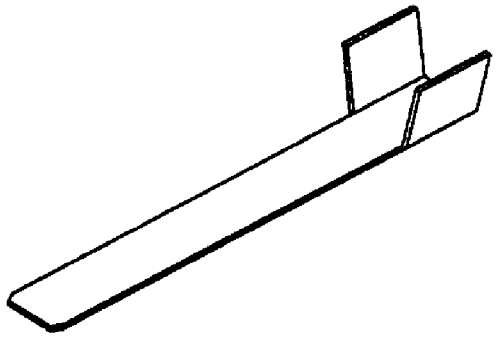
Figure 23:
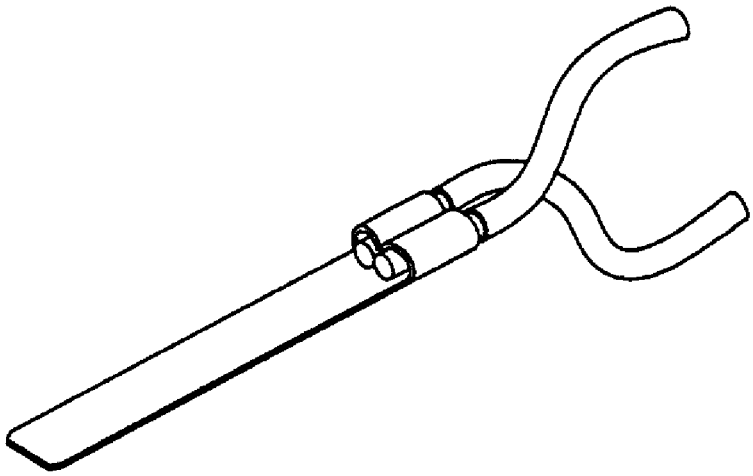
Figure 24:
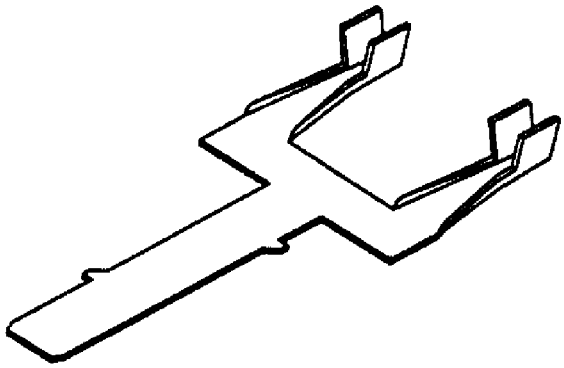
Figure 25:
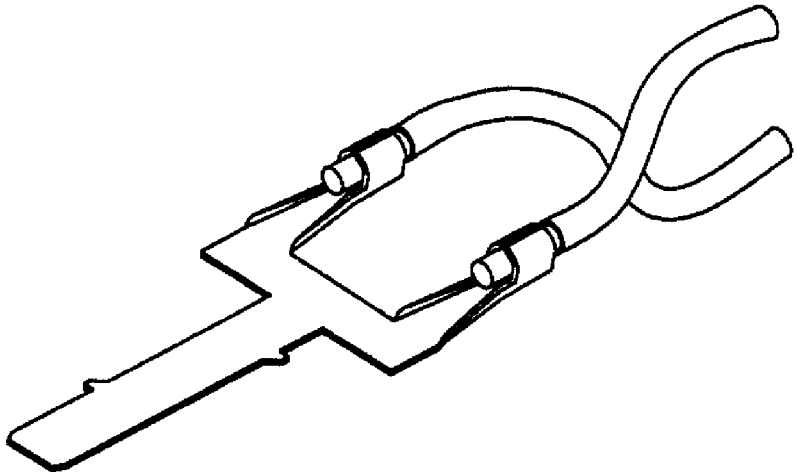

FIG. 20 illustrates the configuration of the jumper assembly 300 as illustrated in FIG. 18. However, FIG. 20 further shows this particular configuration as it may be installed within a series of walls or panels. Specifically, FIG. 20 illustrates the jumper assembly 300 as installed within a first wall or panel 330. The first and second conduits 302, 304 each extend from the jumper assembly 300 are directed in opposing directions within a second wall or panel 332 and a third wall or panel 334. Still further, FIG. 21 illustrates a "four way" interconnection with a pair of jumper assemblies 300. Specifically, FIG. 21 illustrates the jumper assembly configuration of FIG. 19. However, the pair of jumper assemblies 300 is illustrated in FIG. 21 as providing electrical interconnections within a set of four intersecting walls or panels. Specifically, the jumper assemblies 300 are located within the second wall or panel 332 and third wall or panel 334. The first cable connector 326 is located within the first wall or panel 330, while the second cable connector 328 is located within the fourth wall or panel 336.

In accordance with the foregoing, a four way jumper assembly is provided, and can be particularly adapted for use with half block assemblies.

It will be apparent to those skilled in the pertinent arts that still other embodiments of jumper assemblies in accordance with the invention can be designed. That is, the principles of jumper assemblies in accordance with the invention are not limited to the specific embodiments described herein. Accordingly, it will be apparent to those skilled in the art that modifications and other variations of the above-described illustrative embodiments of the invention may be effected without departing from the spirit and scope of the novel concepts of the invention.

The invention claimed is:

1. A jumper assembly adapted for use in connecting junction blocks to conduits having electrical cables running therethrough, and wherein said junction blocks are half junction blocks, said jumper assembly comprising:

a pair of parallel and vertically disposed conduits comprising a first conduit and a second conduit;

a first plurality of wire conductors extending through said first conduit;

a second plurality of wire conductors extending through said second conduit;

said first plurality of wire conductors and said second plurality of wire conductors are each electrically and structurally connected to a terminal set comprising a plurality of contact blade structures;

each of said contact blade structures having an elongated common blade, with each of said common blades extending into an end connector;

a first cover plate;

a second cover plate; and said first and said second cover plates being coupled together so as to enclose said terminals sets and at least part of said end connector.

2. A jumper assembly in accordance with claim 1, characterized in that each contact blade structure of said terminal set is sized and configured substantially as a half H-shaped contact blade structure, with each contact blade structure comprising a first terminal blade connected to one of said first plurality of wire conductors, a second terminal blade connected to one of said second plurality of wire conductors, and with said first and said second terminal blades being commonly integral with or otherwise electrically and conductively connected to a corresponding one of said elongated common blades.

3. A jumper assembly in accordance with claim 1, characterized in that said first conduit is positioned immediately above said second conduit.

4. A jumper assembly in accordance with claim 1, characterized in that said jumper assembly further comprises an insert fitted into said end connector so as to lock said common blades into said end connector when said jumper assembly is assembled.

5. A jumper assembly in accordance with claim 1, characterized in that each of said contact blade structures comprises only one of said elongated common blades, and each of said first plurality of wire conductors and second plurality of wire conductors is electrically and structurally directly connected to a corresponding one of said common blades.

6. A jumper assembly in accordance with claim 5, characterized in that:

each of said first plurality of wire conductors is conductively connected to a corresponding one of said common blades at an end of one lateral edge of said corresponding common blade; and each of said second plurality of wire conductors is conductively connected to a corresponding one of said common blades at an end of an opposing lateral edge of said corresponding common blade.

7. A jumper assembly in accordance with claim 1, characterized in that said first conduit is structurally and electrically coupled to a first one of a pair of ganged cable connectors at an end of said first conduit opposing the end of said first conduit adjacent said first and said second cover plates, and said second conduit is electrically coupled to a second one of said pair of ganged cable connectors at an end of said second conduit opposing the end of said conduit adjacent to said first cover plate and to said second cover plate.

8. A jumper assembly in accordance with claim 1, characterized in that:

said first conduit is electrically coupled to a first ganged cable connector at an end of said first conduit opposing the end of said first conduit adjacent said first cover plate and said second cover plate;

said second conduit is electrically coupled to a second cable connector at an end of said second conduit opposing the end of said second conduit adjacent to said first cover plate and said second cover plate; and said first cable connector and said second cable connector are positioned so as to be in opposing directions.

9. A jumper assembly adapted for use in connecting junction blocks to conduits having electrical cables running therethrough, and wherein said junction blocks are half junction blocks, said jumper assembly comprising:

a first conduit having a first plurality of wire conductors extending through said first conduit;

a second conduit parallel and vertically disposed to said first conduit, and comprising a second plurality of wire conductors extending through said second conduit;

a terminal set comprising a plurality of contact blade structures, each of said contact blade structures comprising a half H-shaped contact blade structure having a first terminal blade, a second terminal blade spaced apart and parallel to said first terminal blade, and elongated common blades extending rearwardly from rear portions of corresponding ones of said first terminal blades and said second terminal blades, and integral therewith;

each of said common blades extending into an end connector, said end connector providing for accessibility of external cabling to said common blades; and a cover enclosing said terminal set and a portion of said end connector.

10. A jumper assembly adapted for use in connecting junction blocks to conduits having electrical cables running therethrough, said jumper assembly comprising:

a first conduit having a first plurality of wire conductors extending through said first conduit and having first and second ends;

a second conduit parallel and vertically disposed to said first conduit, and having a second plurality of wire conductors extending through said second conduit and having first and second ends;

a third conduit having a third plurality of wire conductors extending through said third conduit and having first and second ends;

said first ends of said first plurality of wire conductors and said first ends of said third plurality of wire conductors are each electrically and structurally connected to a first terminal set comprising a plurality of first contact blade structures, each of said contact blade structures having at least an elongated common blade;

a first cover plate;

a second cover plate;

said first and said second cover plates being coupled together so as to enclose said first terminal set and at least part of said first end connector;

said first ends of said second plurality of wire conductors and said second ends of said third plurality of wire conductors are each electrically and structurally connected to a second terminal set comprising a plurality of second contact blade structures, each of said second contact blade structures having an elongated second common blade;

each of said second common blades extending into a second end connector, said second end connector providing for accessibility of external cabling to said second terminal set;

a third cover plate;

a fourth cover plate;

said third and said fourth cover plates being coupled together so as to enclose said second terminal set and at least part of said second end connector; and said second ends of said third plurality of wire conductors being ends opposing said first ends of said third plurality of wire conductors.

* * * * *